US006628183B2

(12) United States Patent
Kang et al.

(10) Patent No.: US 6,628,183 B2
(45) Date of Patent: Sep. 30, 2003

(54) MICRO-ELECTRO MECHANICAL SYSTEM HAVING SINGLE ANCHOR

(75) Inventors: Seok-jin Kang, Kyungki-do (KR); Jin-woo Cho, Kyungki-do (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 10/141,920

(22) Filed: May 10, 2002

(65) Prior Publication Data

US 2002/0167380 A1 Nov. 14, 2002

(30) Foreign Application Priority Data

May 10, 2001 (KR) ..... 2001-25568

(51) Int. Cl.[7] ..... H01P 1/10
(52) U.S. Cl. ..... 333/262; 333/246
(58) Field of Search ..... 333/262, 246; 200/181; 361/277, 281

(56) References Cited

U.S. PATENT DOCUMENTS 5,619,061 A * 4/1997 Goldsmith et al. ..... 257/528
6,147,856 A * 11/2000 Karidis ..... 361/277
6,396,372 B1 * 5/2002 Sakata et al. ..... 335/80
6,486,425 B2 * 11/2002 Seki ..... 200/181
6,549,394 B1 * 4/2003 Williams ..... 361/281

FOREIGN PATENT DOCUMENTS

| | | |
|---|---|---|
| DE | 4305033 | 10/1993 |
| EP | 1024512 | 8/2000 |

* cited by examiner

*Primary Examiner*—Robert Pascal
*Assistant Examiner*—Dean Takaoka
(74) *Attorney, Agent, or Firm*—Burns, Doane, Swecker & Mathis, L.L.P.

(57) ABSTRACT

A micro-electro mechanical system (MEMS) switch having a single anchor is provided. The MEMS switch includes a substrate; grounding lines installed on the substrate to be distant away from each other; signal transmission lines positioned at predetermined intervals between the grounding lines; an anchor placed between the signal transmission lines; a driving electrode that encircles the anchor while not being in contact with the anchor, the signal transmission lines and the grounding lines; and a moving plate that is positioned on the driving electrode to be overlapped with portions of the signal transmission lines, and connected to the anchor elastically.

8 Claims, 4 Drawing Sheets

MICRO-ELECTRO MECHANICAL SYSTEM HAVING SINGLE ANCHOR

BACKGROUND OF THE INVENTION

1. Field of the Invention

The present invention relates to a high-frequency micro-electro mechanical system (hereinafter, "MEMS"), and more particularly, to an MEMS switch having a single anchor.

2. Description of the Related Art

An MEMS switch is a switch that is commonly adopted for signal routing or impedance matching networks in a wire communication system that uses microwave or millimeter wave.

In the existing monolithic microwave integrated circuits, a radio frequency (RF) switch is realized mainly with GaAs FET or a pin diode. However, the use of these elements causes a considerable insertion loss when the RF switch is switched on, and deteriorates signal separation characteristics when the RF switch is switched off.

To improve these problems, much research is made on developing various MEMS switches, and further, a tremendous increase in Mobile communication phone markets increases the importance of the MEMS switches. As a result, a variety of MEMS are suggested.

FIG. 1 is a plan view of a conventional MEMS switch. Referring to FIG. 1, a moving plate 10 is bilateral symmetry, being placed across input-output transmission lines 12 and 14 and a grounding line 16, as shown in FIG. 2. Referring to FIG. 2, the input-output transmission lines 12 and 14 are installed on a substrate S to be distant away from each other, and the moving plate 10 is placed over these input-output transmission lines 12 and 14.

Here, reference numerals 18 and 20 denote first and second anchors for holding the moving plate 10. The first and second anchors 18 and 20 are symmetrical with regard to the input-output transmission lines 12 and 14, and connected to the both ends of the moving plate 10 via first and second springs 22 and 24, respectively. Due to this structure, with the first and second anchors 18 and 20 as holding points, the moving plate 10 is in contact with the input-output transmission lines 12 and 14 by a driving electrode (not shown) when a driving force is given to the moving plate 10, and returns back to the original position when the driving force is canceled from the moving plate 10.

FIG. 3 is a cross-sectional view of the conventional MEMS switch of FIG. 1, taken along the line 3–3'. Referring to FIG. 3, first and second driving electrodes 26 and 28 are installed between the first and second anchors 18 and 20, and actuate the moving plate 10 to be in contact the first and second anchors 18 and 20. The first and second driving electrodes 26 and 28 are separated from each other at a predetermined interval.

Although not shown in the drawings, the input-output transmission lines 12 and 14 and the grounding line 16 are positioned between the first and second driving electrodes 26 and 28.

Referring to FIGS. 1 and 2, the conventional MEMS switch has the moving plate 10 across the input-output transmission lines 12 and 14 and the grounding line 16. Thus, when the moving plate 10 is actuated, it comes in contact with the grounding line 16, which causes the leakage of a transmitted signal. Also, the both ends of the moving plate 10 are fixed by the first and second anchors 18 and 20.

For this reason, the moving plate 10 may transform upward and downward in the event that it thermally expands. A change in the shape of the moving plate 10 may increase driving voltage or power consumption when the MEMS switch is turned on.

SUMMARY OF THE INVENTION

To solve the above-described problems, it is an object of the present invention to provide an MEMS switch capable of preventing an increase in driving voltage due to the leakage of a transmitted signal or the transformation of a moving plate, or power consumption when the MEMS switch is on.

Accordingly, to achieve the above object, there is provided an MEMS switch including: a substrate; grounding lines installed on the substrate to be distant away from each other; signal transmission lines positioned at predetermined intervals between the grounding lines; an anchor placed between the signal transmission lines; a driving electrode not being in contact with the anchor, the signal transmission lines and the grounding lines, the driving electrode for encircling the anchor; and a moving plate positioned on the driving electrode to be overlapped with portions of the signal transmission lines, the moving plate connected to the anchor elastically.

Here, the moving plate is connected to the anchor via springs, and the moving plate and the anchor are connected to each other via four planar springs.

Preferably, the width of the moving plate perpendicular to the grounding lines is the same as the widths of the signal transmission lines.

Preferably, the driving electrode is geometrically shaped the same as the moving plate.

One end of each of the four planar spring is connected to the four corners of the anchor, but the one end of each plate spring is connected to one of two surface consisting of each corner, and the other end of each planar spring is extended from the one end along the surface of the anchor, to which the one end is connected, to connect to the inner surface of the moving plate which is opposite to the other surface of the anchor adjacent to the surface to which the one end is connected.

In an MEMS switch according to the present invention, a moving plate is positioned between grounding lines such that it can be actuated not in contact with these grounding lines. Thus, the MEMS switch according to the present invention is capable of completely transmitting a signal even if the moving plate comes in contact with the grounding lines, or these grounding lines are broken or become narrow. Also, the moving plate is hold by a single anchor, and thus, it is possible to prevent deformation of the moving plate upward and downward even if a substrate expands due to heat from the outside. Therefore, power consumption can be prevented when driving voltage for actuating the moving plate increases or the MEMS switch is switched on.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE INVENTION

Figure 1:
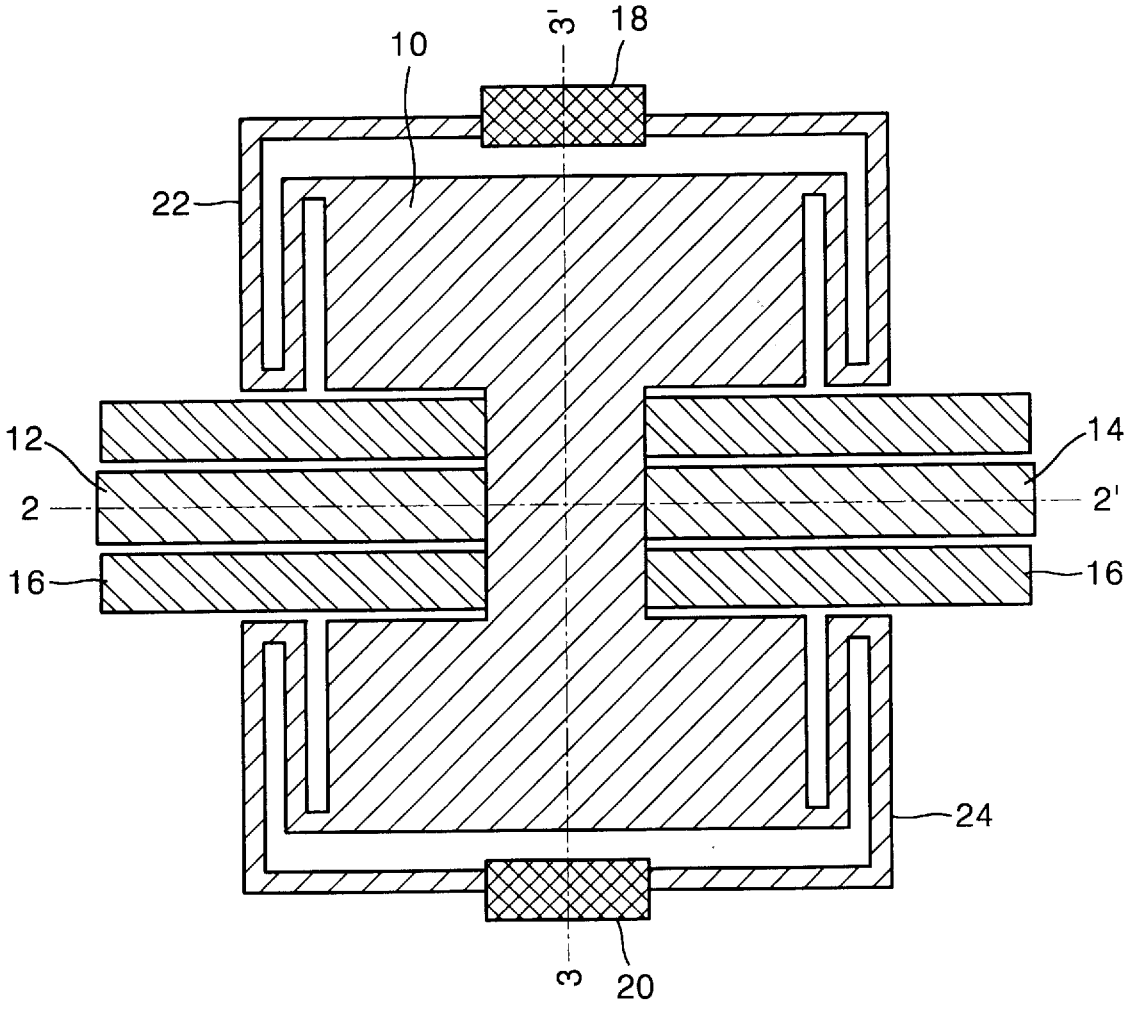
FIG. 1 (PRIOR ART)
FIG. 1 is a plan view of a conventional MEMS switch.
Figure 2:
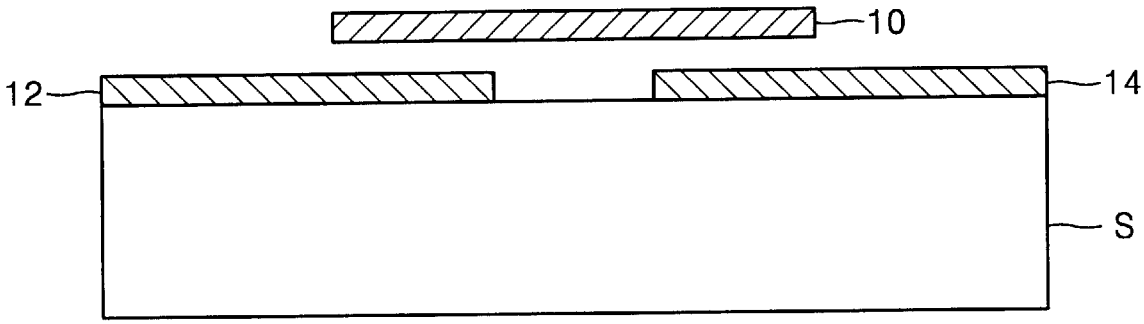
FIG. 2 (PRIOR ART)
FIG. 2 is a cross sectional view of the MEMS switch of FIG. 1, taken along the line 2–2'.
Figure 3:
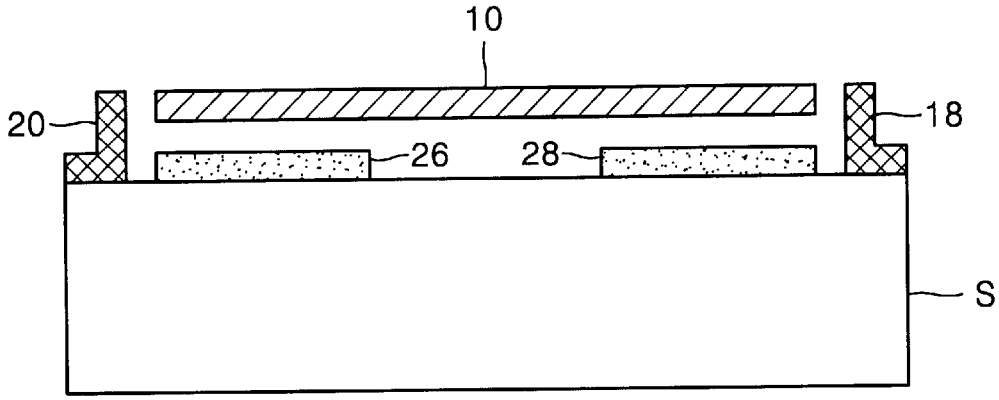
FIG. 3 (PRIOR ART)
FIG. 3 is a cross-sectional view of the MEMS switch of FIG. 1, taken along the line 3–3'.
Figure 4:
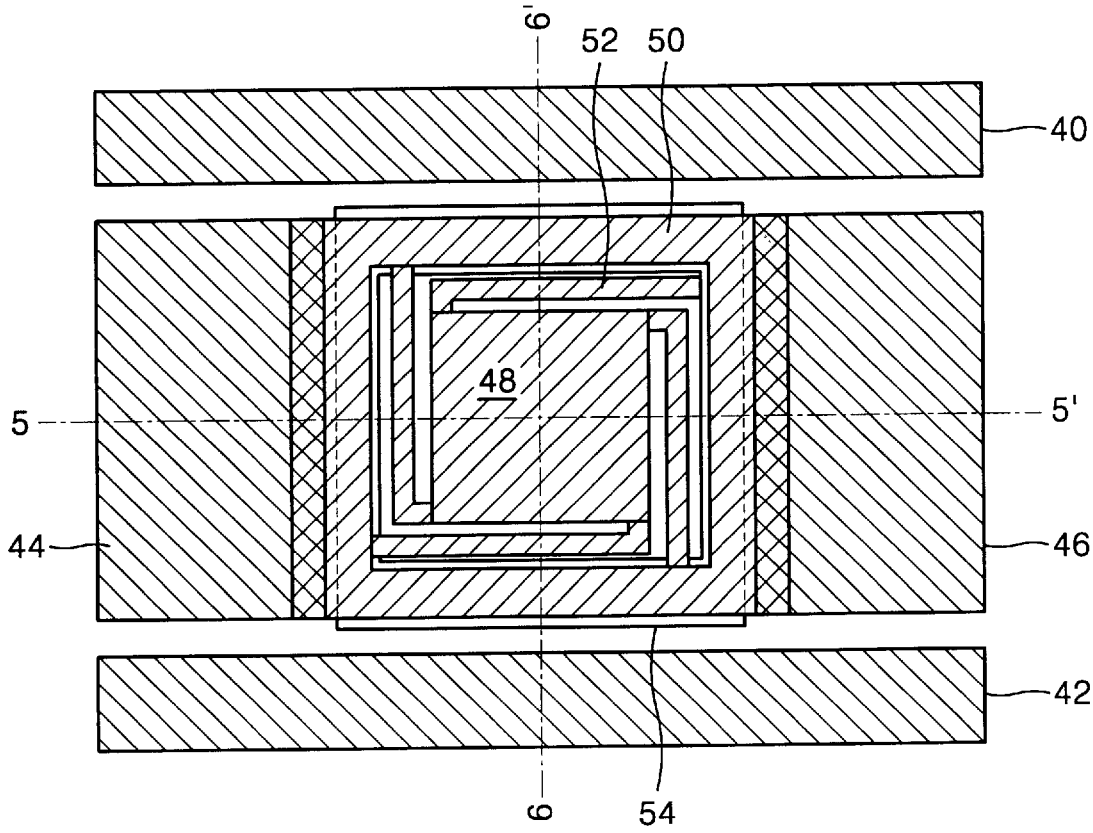
FIG. 4 is a plan view of a preferred embodiment of an MEMS switch having a single anchor according to the present invention.

Referring to FIG. 4, reference numerals 40 and 42 denote first and second grounding lines, respectively. The first and second grounding lines 40 and 42 are separated from each other at a predetermined interval in parallel. Between the first and second grounding lines 40 and 42, first and second signal transmission lines 44 and 46 are positioned at a predetermined interval while not being in contact with the first and second grounding lines 40 and 42. Here, the first and second signal transmission lines 44 and 46 are an input signal transmission line and an output signal transmission line, respectively. Also, an anchor 48 is placed between the first and second signal transmission lines 44 and 46. Here, the anchor 48 is a rectangular single anchor while being distant away from the first and second grounding lines 40 and 42, as well as the first and second signal transmission lines 44 and 46. In this embodiment, the anchor 48 is rectangular shaped, but it may be variously shaped, e.g., round, triangular, pentagonal or hexagonal shaped. A moving plate 50 is located around the anchor 48. The moving plate 50 is a rectangular band having a predetermined width, and encircles the anchor 48. The shape of the moving plate 50 depends on the shape of the anchor 48. If the anchor 48 is round or polygonal, rather than rectangular, the moving plate 50 must be also round or polygonal shaped.

Meanwhile, the moving plate 50 is overlapped with portions of the first and second signal transmission lines 44 and 46, and thus comes in contact with the first and second signal transmission lines 44 and 46 when the moving plate 50 is actuated. Preferably, the width of the moving plate 50 perpendicular to the first and second grounding lines 40 and 42 is the same as the width W of the first and second signal transmission lines 44 and 46, but it may be shorter or longer than the width W of the first and second signal transmission lines 44 and 46 within a range that the moving plate 50 is not in contact with the first and second grounding lines 40 and 42. The anchor 48 and the moving plate 50 are elastically connected to each other.

Four planar springs 52 are installed between the moving plate 50 and the anchor 48 to elastically connecting the anchor 48 with the moving plate 50. The moving plate 50 is elastically connected to the anchor 48 via the four planar springs. One end of each planar spring 52 is connected to the four corners of the anchor 48. However, the one end of each plate spring 52 is connected to one of two surfaces consisting of each corner. The other end of each planar spring 52 is extended from the one end along the surface of the anchor 48, to which the one end is connected, to connect to the inner surface of the moving plate 50 which is opposite to the other surface of the anchor 48 adjacent to the surface to which the one end is connected. In other words, connection form of the planar spring 52 is equal to connecting one of two surfaces consisting of each corner of the anchor 48 with the inner surface of the moving plate 50 one to one and then rotating the anchor 48 counterclockwise or the moving plate 50 clockwise by 90°.

Therefore, due to the elasticity of the planar springs 52, the moving plate 50 can return back to the original position when it is actuated upward or downward.

Here, reference numeral 54 denotes a driving electrode for actuating the moving plate 50. The driving electrode 54 is installed to cover the anchor 48, being distant away from the first and second signal transmission lines 44 and 46, and the first and second grounding lines 40 and 42. The driving electrode 54 has a function of actuating the moving plate 50 to be in contact with the first and second signal transmission lines 44 and 46. For this reason, preferably, the driving electrode 54 is shaped such that its driving force affects the moving plate 50 entirely, and thus, the driving electrode 54 may be taken a geometrical shape the same as the moving plate 50. However, the driving electrode 54 may be geometrically shaped unlike the moving plate 50, if necessary.

Figure 5:
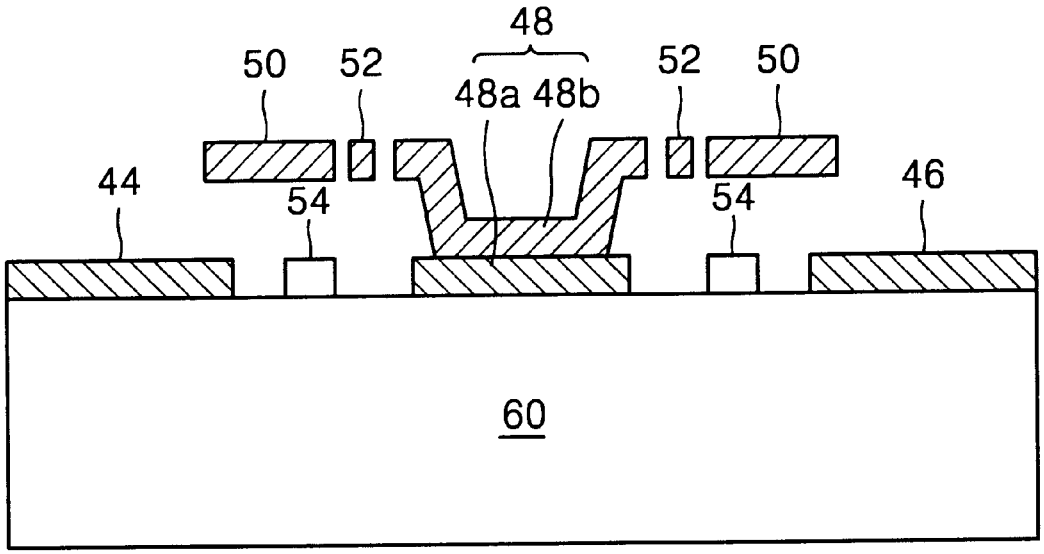
FIG. 5 is a cross-sectional view of the MEMS switch of FIG. 4, taken along the line 5–5'.
Figure 6:
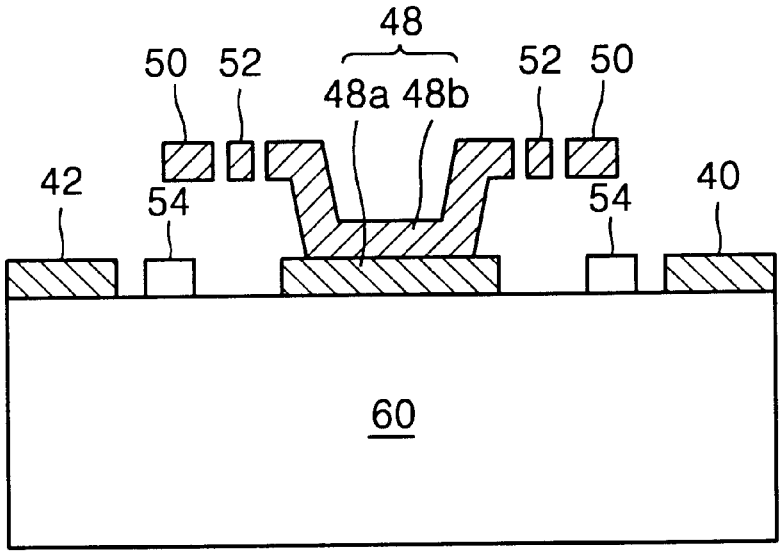
FIG. 6 is a cross-sectional view of the MEMS switch of FIG. 4, taken along the line 6–6'.

The positions of the driving electrode 54, the moving plate 50, and the first and second signal transmission lines 44 and 46 are clarified referring to FIG. 5, and the positions of the driving electrode 54, the moving plate 50, and the first and second grounding lines 40 and 42 are clarified referring to FIG. 6.

First, referring to FIG. 5, the driving electrode 54 is placed between the anchor 48, and the first and second signal transmission lines 44 and 46, on a substrate 60. At this time, the driving electrode 54 is not in contact with the anchor 48, and the first and second signal transmission lines 44 and 46. Also, the anchor 48 consists of a base 48*a* formed on the substrate 60, and a holder 48*b* on the base 48*a*. The holder 48*b* conforms to a wing shape, and thus it is inferred that the holder 48*b* is connected to the planar springs 52 with reference to FIGS. 4 and 5. Further, the moving plate 50 is placed on the driving electrode 54, and extended to the first and second signal transmission lines 44 and 46. The moving plate 50 comes in contact with the first and second signal transmission lines 44 and 46 when the moving plate 50 is actuated, because a portion of the moving plate 50 is overlapped with portions of the first and second signal transmission lines 44 and 46.

From FIG. 6, it is noted that the driving electrode 54 is not in contact with the first and second grounding lines 40 and 42, and the moving plate 50 is not overlapped with the first and second grounding lines 40 and 42.

While this invention has been particularly described with reference to a preferred embodiment thereof, it will be understood by those skilled in the art that various changes in form and details may be made therein without departing from the spirit and scope of the invention as defined by the appended claims. Accordingly, those skilled in the art could have derived another embodiment of an MEMS switch from an MEMS switch having a single anchor according to the present invention. For instance, he or she can invent another MEMS switch by reducing the number of the planar springs 52, changing the way the planar springs 52 are connected to the anchor 48 and the moving plate 50, or forming the moving plate 50 or the planar springs 52 of a different material. Otherwise, portions of the moving plate 50 overlapped with first and second signal transmission lines 44 and 46 may be minimized.

As described above, in an MEMS switch according to the present invention, a moving plate is positioned between grounding lines such that it can be actuated not in contact with these grounding lines. Thus, the MEMS switch according to the present invention is capable of completely transmitting a signal even if the moving plate comes in contact with the grounding lines, or these grounding lines are broken or become narrow. Also, the moving plate is hold by a single anchor that is positioned between input and output signal transmission lines and grounding lines. For this reason, it is possible to prevent the deformation of the moving plate upward and downward even if a substrate expands due to heat from the outside. Therefore, power consumption can be prevented when driving voltage for actuating the moving plate increases or the MEMS switch is switched on.

What is claimed is:

1. An MEMS switch comprising:

a substrate;

grounding lines installed on the substrate to be distant away from each other;

signal transmission lines positioned at predetermined intervals between the grounding lines;

an anchor placed between the signal transmission lines;

a driving electrode not being in contact with the anchor, the signal transmission lines and the grounding lines, the driving electrode for encircling the anchor; and a moving plate positioned on the driving electrode to be overlapped with portions of the signal transmission lines, the moving plate connected to the anchor elastically.

2. The MEMS switch of claim 1, wherein the moving plate is connected to the anchor via springs.

3. The MEMS switch of claim 1, wherein the moving plate encircles the anchor.

4. The MEMS switch of claim 2, wherein the moving plate and the anchor are connected to each other via four planar springs.

5. The MEMS switch of claim 1, the width of the moving plate perpendicular to the grounding lines is the same as the widths of the signal transmission lines.

6. The MEMS switch of claim 1, wherein the driving electrode is geometrically shaped the same as the moving plate.

7. The MEMS switch of claim 4, wherein one end of each of the four planar spring is connected to the four corners of the anchor, but the one end of each plate spring is connected to one of two surface consisting of each corner, and the other end of each planar spring is extended from the one end along the surface of the anchor, to which the one end is connected, to connect to the inner surface of the moving plate which is opposite to the other surface of the anchor adjacent to the surface to which the one end is connected.

8. The MEMS switch of claim 1, wherein the anchor comprises:

a base formed on the substrate; and a holder formed on the base.

* * * * *